United States Patent [19]

Torita

[11] 4,235,085

[45] Nov. 25, 1980

[54] AUTOMATIC WASHER

[75] Inventor: Fumio Torita, Nagoya, Japan

[73] Assignee: Tokyo Shibaura Denki Kabushiki Kaisha, Kawasaki, Japan

[21] Appl. No.: 25,601

[22] Filed: Mar. 30, 1979

[30] Foreign Application Priority Data

Apr. 4, 1978 [JP] Japan ..... 53-39369
Apr. 4, 1978 [JP] Japan ..... 53-39370

[51] Int. Cl.[3] ..... D06F 33/02
[52] U.S. Cl. ..... 68/12 R
[58] Field of Search ..... 68/12 R; 134/57 R, 57 D

[56] References Cited

FOREIGN PATENT DOCUMENTS 43-17558 7/1968 Japan .
47-39323 11/1972 Japan .
48-16080 5/1973 Japan .
48-23178 7/1973 Japan .
49-29331 8/1974 Japan .
50-13447 5/1975 Japan .

*Primary Examiner*—Philip R. Coe
*Attorney, Agent, or Firm*—Cushman, Darby & Cushman

[57] ABSTRACT

An automatic washer provided with drive means for rotating a stirring blade member or dehydration tub and control device for successively carrying out the respective steps of the washer by controlling the operation of the drive means, which comprises a detector of a charged quantity of material of washing whose control means is connected to the drive means, detects a length of time actually required for the drive means to be operated in a prescribed number of rotations, determines a quantity of material of washing put in a washing tub from said required length of time and issues a signal denoting said charged quantity of material of washing; and an operation step period presetter for defining the periods of the respective operation steps of the washer from the contents of a signal denoting said charged quantity of material of washing.

8 Claims, 18 Drawing Figures

AUTOMATIC WASHER

This invention relates to an automatic washer designed to detect a charged quantity of material of washing and carry out the respective steps of washing (including rinsing and dehydration) only for a length of time corresponding to said detected quantity.

The operation of the known automatic washer has been made to proceed from step to step by a timer consisting of cam switches and a timer motor. The function of the timer is easily effected when the closed condition of the contacts of the respective cam switches is shifted by the rotation of the timer motor. Where, however, material of washing is put in the washer in too large an amount per period of washing, the material of washing is not smoothly handled, making it necessary to operate the washer for a long time in order to carry out proper cleaning. Conversely, where material of washing is put in the washer in too small an amount per period of washing, then the charged fabric is handled too quickly and consequently roughly. If the washer is operated too long under such condition, the fabric is likely to be damaged. Therefore, the prior art automatic washer has the drawbacks that where the above-mentioned type of timer is applied, the periods in which the respective operation steps are taken are rigidly defined by the rotation speed of the timer motor; the washing rate falls, in case too much fabric is put in the washer; further, the fabric is also likely to be damaged during washing, if it is taken into the washer in too small an amount; where, during dehydration, a dehydration tube is rotated too quickly, the washed fabric tends to be creased; and where the dehydration tub is turned too slowly, the washing fabric is not sufficiently dehydrated.

It is accordingly an object of this invention to provide an automatic washer which is designed to detect a quantity of material of washing put in a washer body and carry out the respective operation steps for lengths of time specified therefor in accordance with said charged quantity.

Another object of the invention is to provide an automatic washer, wherein a stirring blade member is intermittently rotated during washing and rinsing for a length of time specified in accordance with the charged quantity of material of washing.

Still another object of the invention is to provide an automatic washer, wherein a dehydration tub is intermittently rotated for a length of time defined also in conformity to a charged quantity of material of washing.

The above-mentioned objects are attained by providing an automatic washer which comprises drive means for rotating a stirring blade member or a dehydration tub; and control means connected to the drive means successively to carry out the respective operation steps of the washer for lengths of time determined by a signal denoting a charged quantity of material of washing is issued during a washing cycle in accordance with the rotation characteristic of the drive means.

This invention can be more fully understood from the following detailed description when taken in conjunction with the accompanying drawings, in which.

Figure 4:
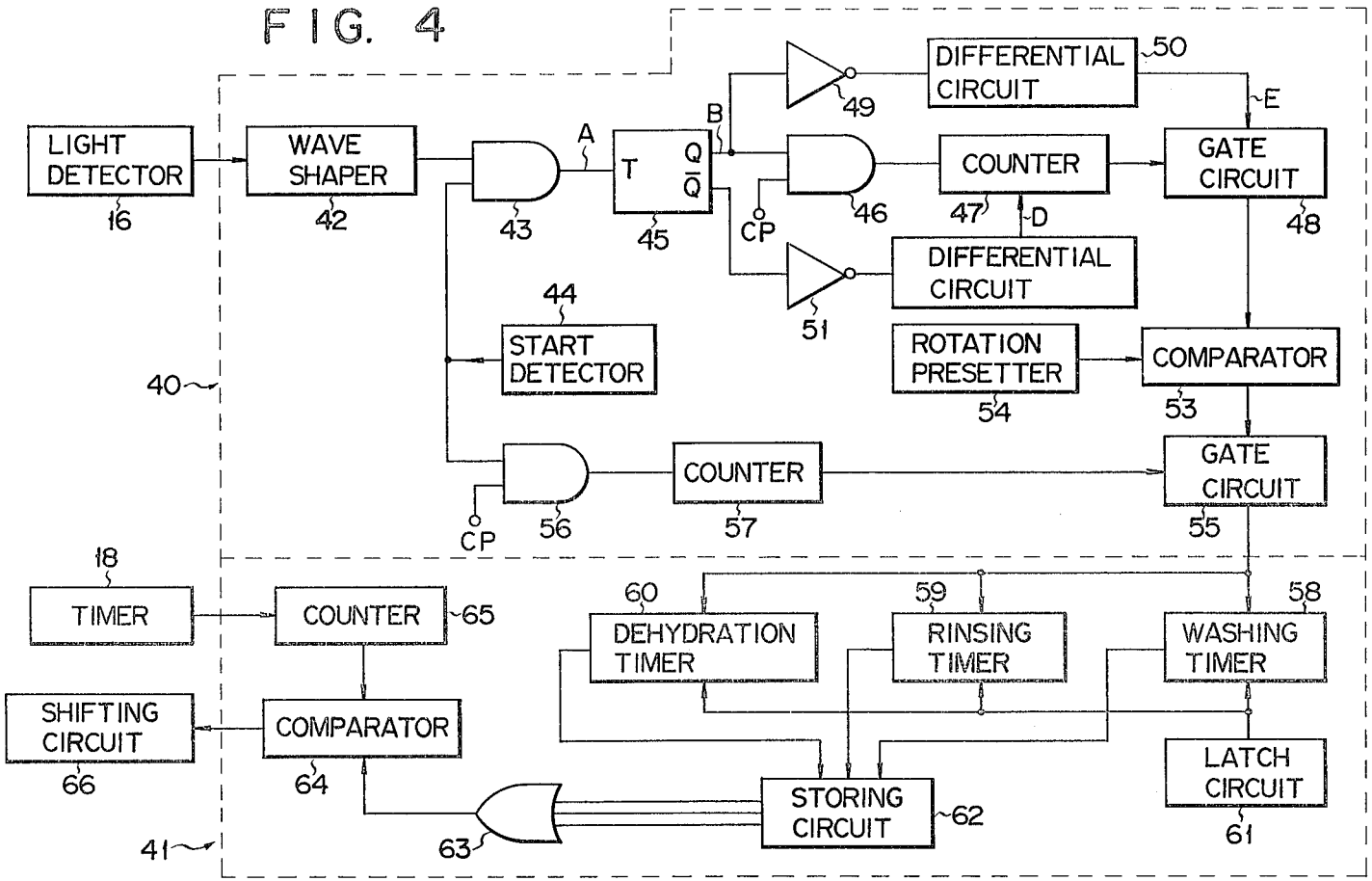
FIG. 4 is a block diagram of a detector for determining a quantity of material of washing put in a washer body and a circuit for defining the periods of the respective operation steps in accordance with said charged quantity of material of washing.
Figure 5:
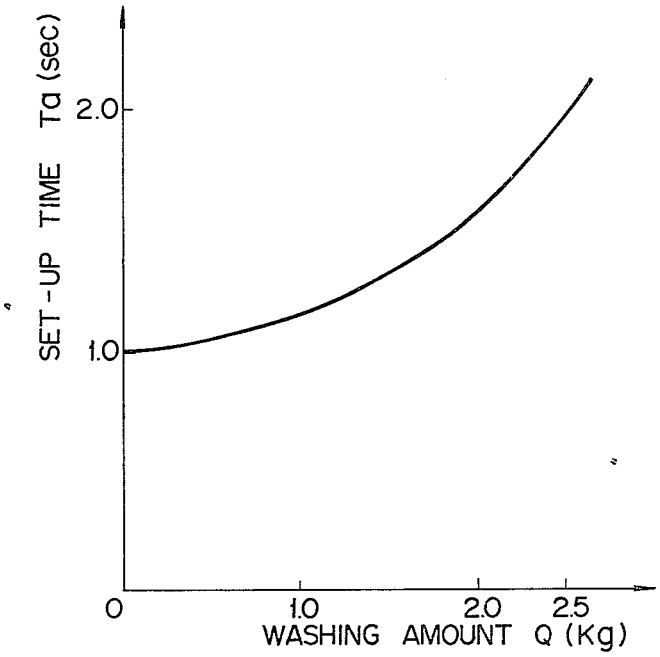
Figure 7:
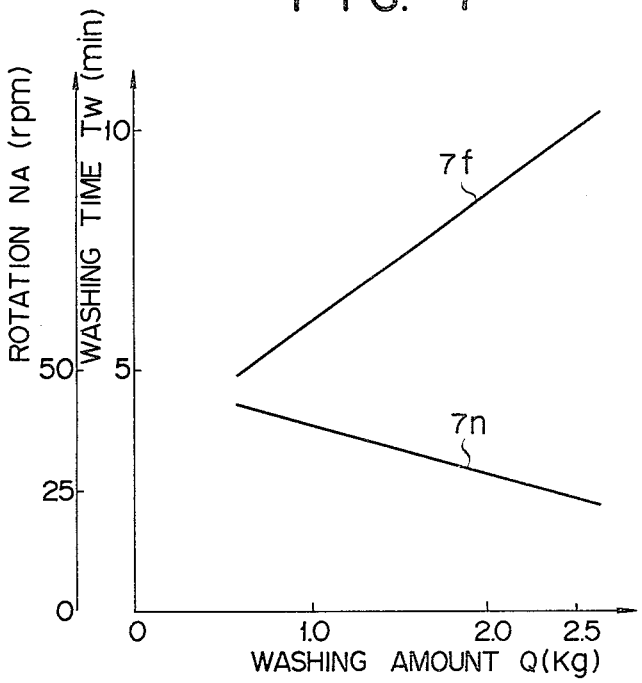
Figure 8:
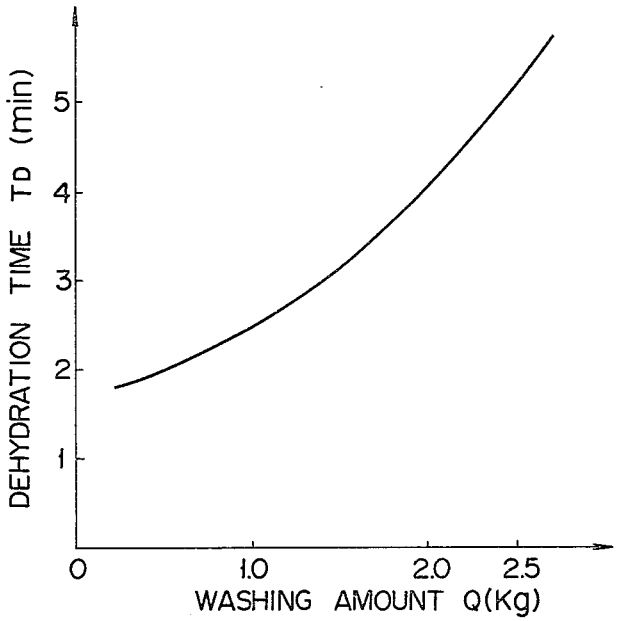
Figure 9:
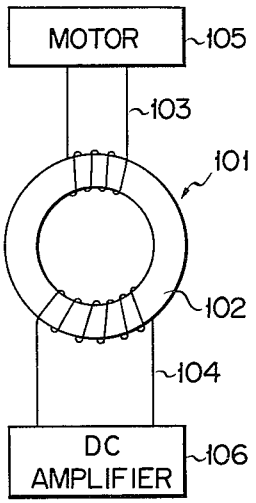
Figure 11:
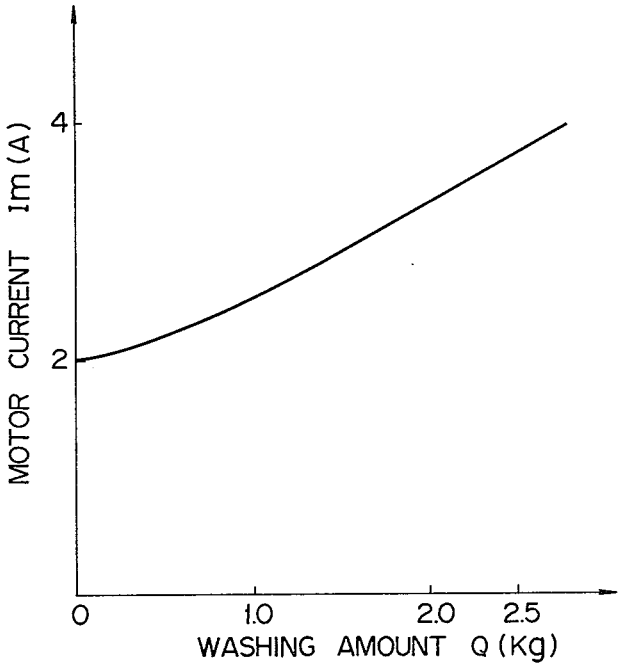
Figure 10:
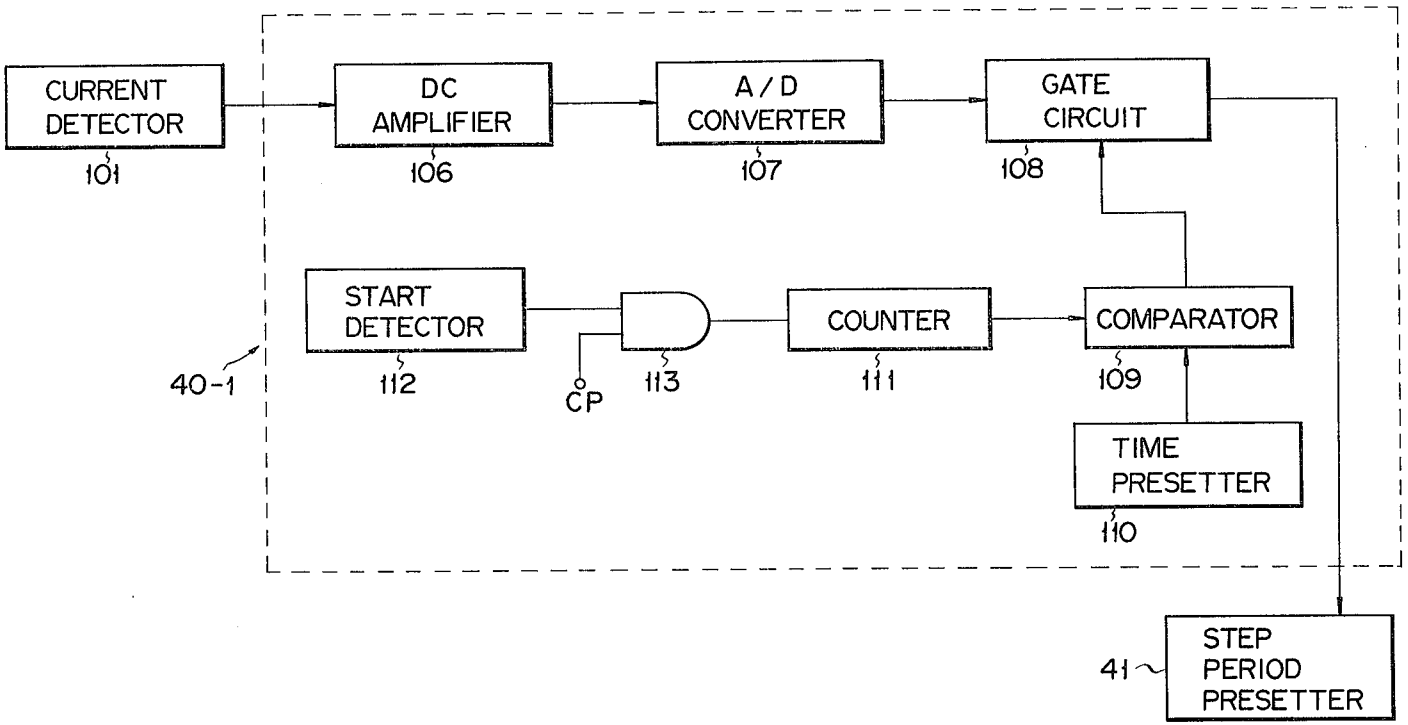
Figure 12:
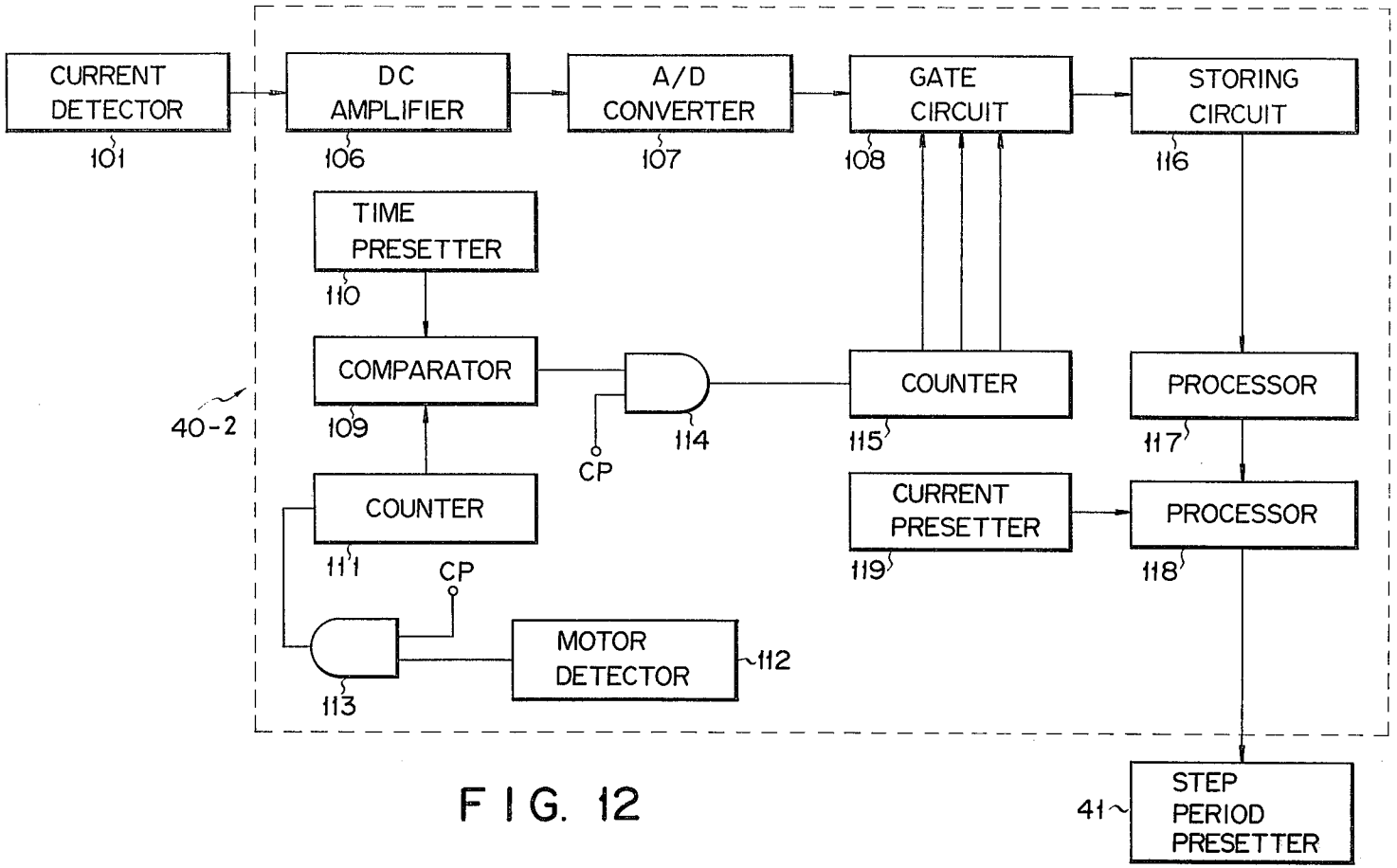
Figure 13:
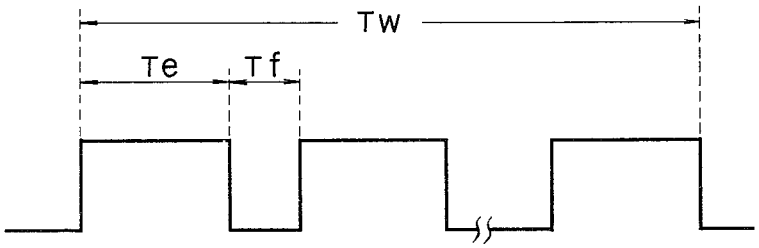
Figure 14:
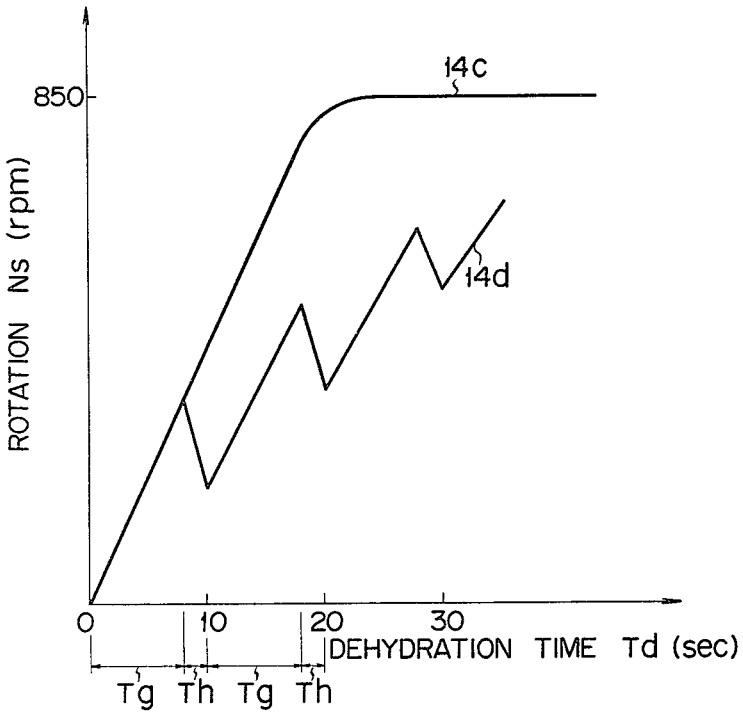

FIG. 5 graphically indicates a time characteristic of a washer motor appearing during the period in which the number of its rotations reaches a required level for cleaning, showing the principle by which the automatic washer of the invention detects the charged quantity of material of washing;

FIGS. 6A to 6E is a timing chart, showing the waveforms of signals generated at the various parts of the main section of a circuit for detecting the charge quantity of material of washing;

FIG. 7 indicates the time characteristic of washing, and the rotation characteristic of the fabric of washing;

FIG. 8 sets forth the time characteristic of dehydration;

FIG. 9 schematically illustrates a detector of washer motor current, a modification of the detector of the charged quantity of material of washing shown in FIG. 4;

FIG. 10 is a block diagram of detector of the charged quantity of material of washing including the detector of washing motor current of FIG. 9;

FIG. 11 illustrates the current characteristic of a washer motor, showing the principle by which the charged quantity of material of washing is detected;

FIG. 12 is a block circuit diagram of a detector of the charged quantity of material of washing according to another embodiment of the invention;

FIG. 13 is a timing chart showing the operative and inoperative conditions of a washer motor during a washing cycle; and FIG. 14 indicates the rotation characteristic of the washer motor during a dehydration cycle.

Figure 1:
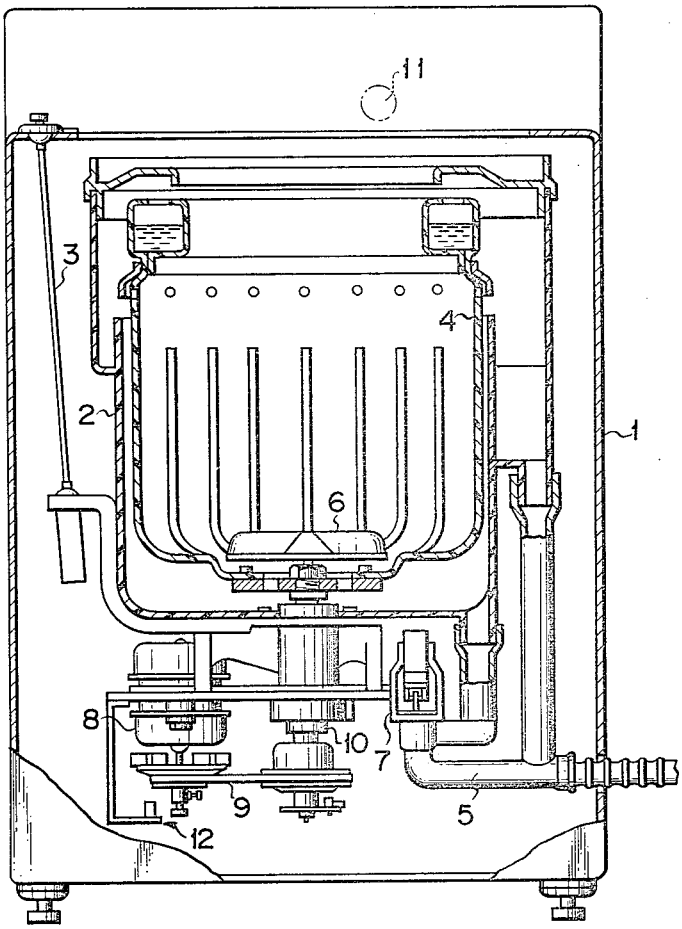
FIG. 1 is a fractional vertical sectional view of an automatic washer embodying this invention.

There will now be described by reference to the accompanying drawings an automatic washer embodying this invention. FIG. 1 is a fractional vertical sectional view of said automatic washer with one of the lateral walls taken off. A water tank 2 is built in an outer box section 1 in a state vertical movable by means of an elastic support 3. The water tank 2 contains a rotary tub 4 used concurrently for washing and dehydration, and is fitted at the bottom with a water-draining passage 5. At the time of dehydration, the rotary tub 4 is rotated to cause water pumped up by said rotation to be expelled out of a washer body through the water drain passage 5. The bottom is provided with a stirring blade member 6 and communicates in water tightness with the water drain passage 5 by means of a water guide passage (not shown). The water-draining action of the water guide passage is controlled by a water drain valve 7 disposed at the intermediate point of the water drain passage 5. The rotation moment of a washer motor 8 is selectively transmitted to the rotary tub 4 or stirring blade member 6 by means of a belt 9 and drive transmission control mechanism 10. A water valve 11 is set above the outer box section 1.

Figure 2:
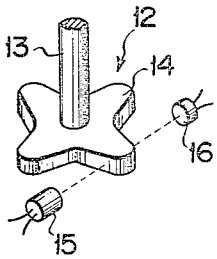
FIG. 2 is an oblique view of a detector of the rotation of a washer motor.

As seen from the enlarged oblique view of FIG. 2, the motor rotation detector 12 comprises a gear 14 fitted to a rotation shaft 13 of the washer motor 8; a light radiator 15; and a light detector 16 for intermittently receiving light beams issued from the light radiator 15 by the rotation of the gear 14.

There will now be described by reference to FIG. 3 the arrangement and operation of a control circuit for automatically controlling the operation of an automatic washer embodying this invention. An electronic control circuit 17 enclosed in broken lines comprises, as is well known, an electronic timer 18, control processing unit (hereinafter abbreviated as "CPU") 19, clock pulse control circuit 20, memory 21, input buffer control circuit 22 and output buffer control circuit 23. As used herein, the electronic timer 18, clock pulse control circuit 20, and buffer control circuits 22, 23 are all of the known type. An external input section 24 comprises a power switch 25; a cover switch 26 rendered conducting when a washer cover is closed; a water level switch 27 for detecting the level of water held in the rotary tub 4; a program selector 28 for selecting a proper combination of operation steps; elements 29 to 32 for shifting the operation made of, for example, a flip-flop circuit designed to convert said respective operation steps into logical codes of "1" and "0"; and the light detector 16 of the motor rotation detector 12. Output pulses from the operation made-shifting elements 29 to 32 and light detector 16 are supplied to the input buffer control circuit 22. An external output section 33 comrises the water drain valve 7; the washer motor 8; the water valve 11; the light radiator 15 of the motor rotation detector 12; a display device 34 for visually indicating the completion of the entire operation of the washer; and switching elements such as thyristors 35 to 39 for controlling power supply to all the elements of said external output section 33. The CPU 19 receives an input signal supplied from the external input section 24 through the input buffer control circuit 22 and cause data on the periods of the respective operation steps of the washer to be read out of the memory 21, thereby supplying output signals through the output buffer control circuit 23 to the respective units of the external output section 33 required for execution of said operation steps. The operation steps are shifted by the electronic timer 18, and the periods in which said operation steps are carried out are defined in accordance with the charged quantity of material of washing.

There will now be described by reference to the block diagram of FIG. 4 the arrangement and operation of a circuit 40 for detecting a charged quantity of material of washing and those of a circuit 41 for defining the periods in which the respective operation steps of the automatic washer of this invention are executed. Both circuits 40, 41 constitute part of the CPU 19 and memory 21.

There will now be described the principle by which a charged quantity of material of washing is detected by the method of this invention. Where material of washing and a detergent are taken into the rotary tub 4, and the power switch 25 is thrown in, then the washer commences water supply by means of the electronic control circuit 17. At this time, the light radiator 15 sends forth a light. When water flows into the rotary tub 4 up to a prescribed level, then the operation of the water level switch 27 is reversed, causing the operation of the washer to be shifted to a washing step. As a result, the washer motor 8 begins to be driven. At this time, the gear 14 coupled to the rotation shaft 13 of the washer motor 8 is also turned, causing the teeth of the gear 14 to cross a light path. The light detector 16 intermittently receives a light. Output pulses from said light detector 16 have such a width as corresponds to the number of rotations of the washer motor 8. In FIG. 5, a length of set-up time Ta required for a number of rotations of the washer motor 8 to reach a prescribed number of $N_1$ is plotted on the ordinate, and the charged quantity Q of material of washing is shown on the abscissa, thus indicating the time characteristic of the rotation of the washer motor 8. As apparent from FIG. 5, the required length of set-up time $T_a$ tends to be extended, as material of washing is taken into the rotary tub 4 in a larger amount. If, therefore, measurement is made of the required length of set-up time $T_a$ extending from a point of time at which the washer motor 8 commences rotation (or the number of said rotations stands at a level lower than the aforesaid $N_1$) to a point of time at which the number of said rotations arrives at the prescribed level of $N_1$, then the charged quantity Q1 of material of washing can be determined.

There will now be described by reference to FIG. 4 the arrangement and operation of a detector 40 of a charged quantity of material of washing, which is based on the above-mentioned principle. The light detector 16 of the external input section 24 is connected to one of the input terminals of an AND circuit 43 through a wave shaper 42. A motor start detector 44 is connected to the other input terminal of the AND circuit 43. The output terminal of the AND circuit 43 is connected to the T terminal of a T flip-flop circuit 45, the Q terminal of which is connected to the input terminal of a first gate circuit 48 through an AND circuit 46 and first counter 47, and also to the control terminal of said first gate circuit 48 through an inverter 49, and differential circuit 50. The other input terminal of the AND circuit 46 is supplied with clock pulses. The $\overline{Q}$ terminal of the flip-flop circuit 45 is connected to the reset terminal of the first counter 47 through an inverter 51 and differential circuit 52. One of the input terminals of a first comparator 53 is connected to the output terminal of the first gate circuit 48, and the other input terminal of the first comparator 53 is connected to a rotation presetter 54. The output terminal of said first comparator 53 is connected to the control terminal of a second gate circuit 55. The motor start detector 44 is connected to the input terminal of the second gate circuit 55 through an AND circuit 56 and second counter 57. The other input terminal of the AND circuit 56 is supplied with clock pulses.

Figure 6A:
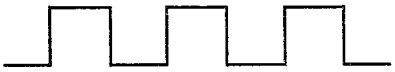
Figure 6B:
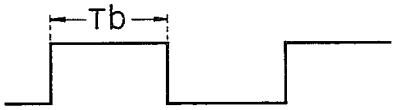
Figure 6C:
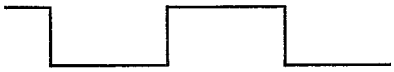
Figure 6D:
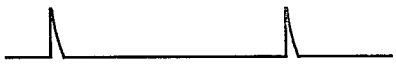
Figure 6E:
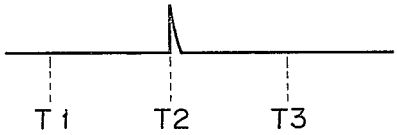

There will now be described by reference to the timing chart of FIG. 6 the operation of the detector 40 of a charged quantity of material of washing arranged as described above. FIGS. 6A to 6E illustrate the waveforms of signals A to E generated in the detector 40. When the washer motor 8 is rotated, the light detector 16 sends forth rotation detection pulses having a width corresponding to a number of rotations of the washer motor 8. At this time, the motor start detector 44 generates a start detection signal. As a result, a rotation detection pulse A of FIG. 6A is supplied to the T flip-flop circuit 45 through the AND circuit 43. Q and $\overline{Q}$ output pulses from the T flip-flop circuit 45 respectively have the waveforms of FIGS. 6B and 6C. The width $T_b$ of these pulses are proportional to a number of rotations of the washer motor 8. At time $T_1$, a pulse D having the waveform of FIG. 6D is sent forth from the differential circuit 52 in synchronization with the fall of a pulse C. Consequently, a count made by the first counter 47 is cleared to zero. At this time, a pulse B causes a clock pulse to be supplied to the first counter 47 through the AND circuit 46. The first counter 47 commences counting. At time $T_2$, when the operation mode of the T flip-flop circuit 45 is reversed, a pulse E of FIG. 6E is issued from the differential circuit 50 in synchronization with the fall of the pulse B. The pulse E opens the first gate circuit 48. At this time, the pulse B renders the AND circuit 46 nonconducting. A signal denoting a number of clock pulses counted by the first counter 47 during an interval between $T_1$ and $T_2$ is supplied to one of the input terminals of the first comparator 53. Later at time $T_3$, the operation made of the T flip-flop circuit 45 is reversed again, and the first counter 47 has its count again cleared to zero by the pulse D and resumes the counting of clock pulses. The first counter 47 repeatedly counts clock pulses issued during the high level period of a Q output signal from the T flip-flop circuit 45 or a pulse B of FIG. 6B. A counted number of said pulses B also corresponds to a number of rotations of the washer motor 8 driven from time to time. The first comparator 53 makes a comparison between a count made by the first counter 47 and data $N_1$ on a prescribed number of rotation of the washer motor 8 previously stored in the rotation presetter 54. Where a coincidence arises as a result of said comparison, that is, where the washer motor 8 begins to be driven in the prescribed number of rotation $N_1$, then the first comparator 53 issues a coincidence pulse.

The second counter 57 begins to count clock pulses passing through the AND circuit 56 when a motor start detection signal is issued. Upon receipt of the coincidence pulse, the second gate circuit 55 is opened to cause a count made by the second counter 57 to be read out therefrom. The second counter 57 has been counting clock pulses issued during a period extending from a point of time at which the washer motor 8 began to be rotated to a point of time at which a number of rotations of said washer motor 8 reached the prescribed level $N_1$. A counter number of said clock pulses represents data corresponding to a length of time $T_a$ required for proper washing. Said data is transmitted to the operation step period presetter 41 as a signal denoting a charged quantity of material of washing.

There will now be described by reference to FIG. 4 the arrangement and operation of the operation step period presetter 41. The output terminal of the second gate circuit 55 included in the detector 40 of a charged quantity of material of washing is connected to the input terminals of washing timer 58, rinsing timer 59 and dehydration timer 60 respectively. A latch circuit 61 which sends forth a latch signal when the first comparator 53 issues a coincidence pulse is also connected to the above-mentioned timers 58 to 60. The output terminals of the timers 58 to 60 are connected to the corresponding input terminals of an OR circuit 63 included in the CPU 19 through the storing circuit 62 of the memory 21. The output terminal of the OR circuit 63 is connected to one of the input terminals of a second comparator 64, the other input terminal of which is connected to a third counter 65 which is supplied with timing pulses sent forth the electronic timer 18.

With the operation step period presetter 41 arranged as described above, the washing timer 58 converts a signal denoting a charged quantity of material of washing to a signal representing a length of time actually required for a washing period in accordance with the washing time characteristic of FIG. 7. Referring to FIG. 7, the character $N_a$ given on the ordinate denotes a number of times the charged material of washing is rotating in the rotary tub 4 for a prescribed length of time, the character $T_W$ also given on the ordinate denotes a length of washing period. The character Q shown in the abscissa represents the charged quantity of material of washing. A straight line $7_N$ indicates the rotation characteristic of the charged material of washing, and a straight line $7_T$ means the time characteristic of washing. As seen from FIG. 7, the number of rotations $N_a$ decreases according as the charged quantity Q of material of washing increases. Therefore, a length of washing time $T_W$ actually required to cause the charged material to be washed to desired level of cleaning increases. Where a proper relationship is established between the factors Q and $T_W$, it is possible to define an optimum length of actual washing time. An optimum length of actual rinsing time can be determined in the same manner in accordance with the detected charged quantity of material of washing. With the automatic washer of this invention, a rinsing time is chosen to be shorter than a washing time. The dehydration timer 60 converts a signal representing the charged quantity of material of washing into a signal denoting a length of time actually required for dehydration, in accordance with the time characteristic of dehydration shown in FIG. 8. Even when the charged quantity of material of washing changes, the rate of dehydration does not generally much increase over 52% to 54%, once the level is reached, no matter how much dehydration time is extended. In other words, the rate of dehydration becomes substantially fixed at a certain level. As used herein, the term "rate of dehydration" is defined to mean a percentage quotient arrived at by dividing the weight of dry material of washing by the weight of said material after dehydration. Referring to FIG. 8, a charged quantity Q of material of washing is plotted on the abscissa. A length of time $T_d$ actually required for the rate of dehydration to reach the above-mentioned substantially constant level is shown on the ordinate. Where a proper relationship is established between these factors Q and $T_d$, then an optimum length of dehydration time can be determined.

Where receiving a latch pulse from the latch circuit 61, the above-mentioned washing timer 58, rinsing timer 59 and dehydration timer 60 temporarily hold signals denoting actually required lengths of washing time, rinsing time and dehydration time all based on a signal representing a charged quantity of material of washing. Signals denoting these required lengths of time for washing, rinsing and dehydration are stored in the storing circuit 62. In washing, a signal denoting the actually required length of washing time is immediately read out of the storing circuit 62. The signal is supplied to one of the input terminals of the second comparator 64 through the OR circuit 63. At this time, the third counter 65 begins to count timing pulses issued from the electronic timer 18. Momentarily varying count signals are conducted to the other input terminal of the second comparator 64. Where coincidence taken place between an output count signal from the third counter 65 received at said one input terminal of the second comparator 64 and a signal representing an actually required length of washing time received at the other input terminal of the second comparator 64, that is, where washing is carried out for a prescribed length of time denoted by said signal, then the second comparator 64 issues a stop signal. As a result, an operation step-shifting circuit 66 shifts the washing step to the succeeding step. The rinsing and dehydration steps are carried out only for a specified length of time in accordance with the aforesaid principle.

There will now be described by reference to FIGS. 9 to 11 the arrangement and operation of a modification of the detector 40 of a charged quantity of material of washing.

The parts of FIGS. 9 to 11 the same as those of FIG. 1 are denoted by the same numerals, description thereof being omitted. This modification has substantially the same arrangement as that of FIG. 1, except that the motor rotation detector 12 is replaced by a motor current detector 101. FIG. 9 shows the wiring pattern of this motor current detector 101. Primary winding 103 and secondary winding 104 are wound about a core 102. The primary winding 103 is connected in series to a washer motor 105. The seconding winding 104 is connected to a D.C. amplifier.

Figure 3:
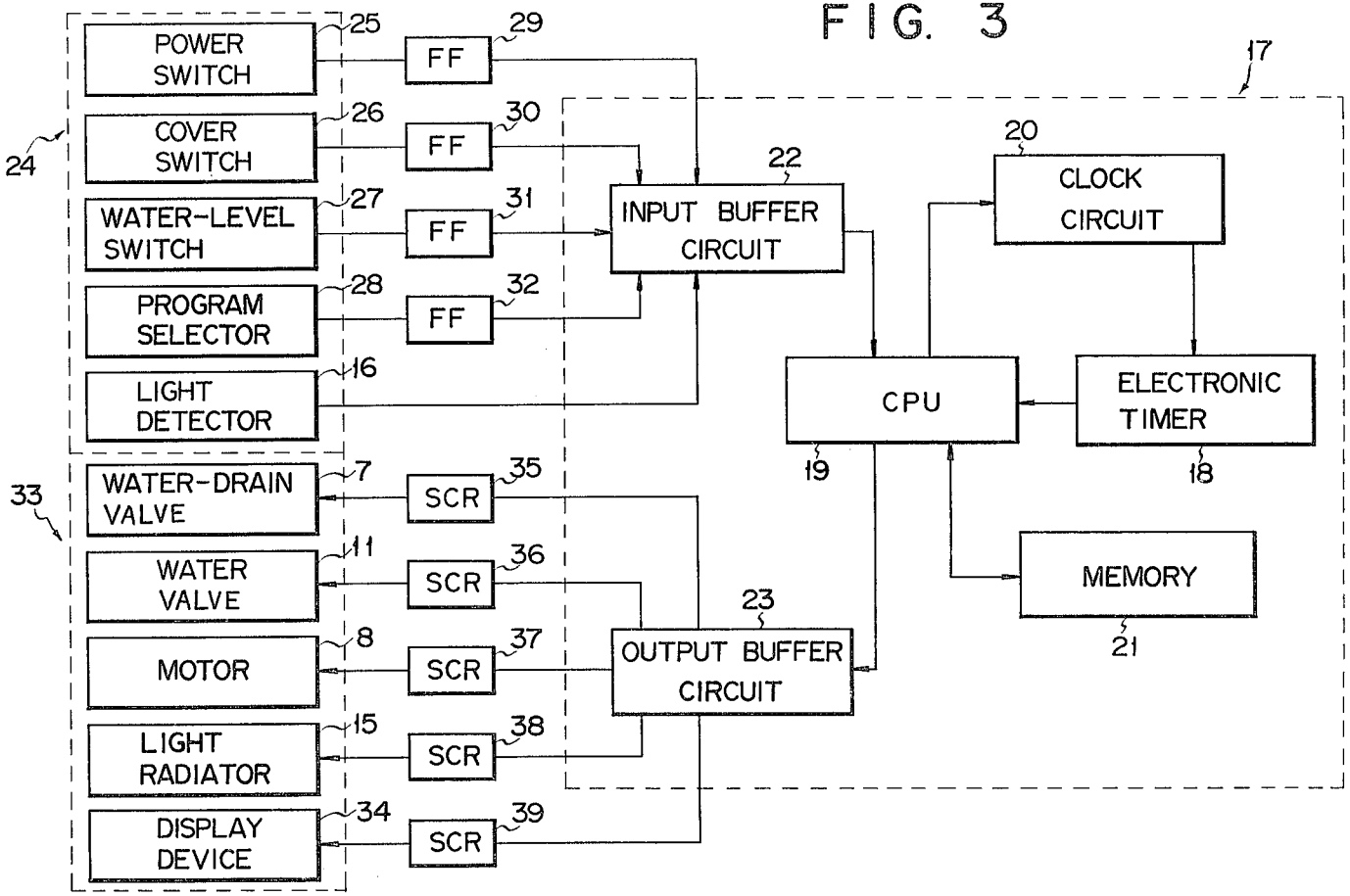
FIG. 3 is a block diagram of the entire control circuit of the subject automatic washer.

The arrangement of this modification differs from the block diagram of FIG. 3 only in that the light detector 16 of the external input section 24 is replaced by the motor current detector 101, and the light radiator 15 is substituted by a display lamp. This display lamp visually indicates the completion of the entire operation of the subject automatic washer as does the aforesaid display device 34.

FIG. 11 is a block circuit diagram of a detector 40-1 of a charged quantity of material of washing which constitutes the key section of this modified washer. FIG. 10 shows the current characteristic of a washer motor based on the principle of detecting the charged quantity of material of washing according to the method of this invention. The charged quantity Q of material of washing is plotted on the abscissa. The ordinate represents motor current $I_m$ which is generated in a specified length of time $T_a$ after the start of a washer motor 105. As seen from FIG. 11, measurement of a motor current $I_m$ produced in the specified length of time $T_a$ after the start of the washer motor 105 can determine the charged quantity Q of material of washing.

These data are in a case in which water level is high (a amount of water is 33 liter) and water stream is fourthful. Some other data will be shown in next Table.

Table of motor current $I_m$ (A)

| | A amount of Water (liter) | | | |
|---|---|---|---|---|
| | 30 | | 33 | |
| | Washing Amount Q (kg) | | | |
| Water Stream | 0.5 | 2.5 | 0.5 | 2.5 |
| Fourthful | 2.1 | 3.2 | 2.1 | 3.6 |
| Weak | 2.0 | 3.2 | 2.0 | 3.5 |

The motor current detector 101 is connected to the input terminal of a gate circuit 108 through a D.C. amplifier 106 and analog-digital (AD) converter 107. The control terminal of the gate circuit 108 is connected to a comparator 109, one of whose input terminals is connected to a time presetter 110, and the other input terminal of which is connected to the output terminal of a counter 111. The input terminal of the counter 111 is supplied with clock pulses CP and connected to a motor start detector 112 through an AND circuit 113. The gate circuit 108 is connected to the operation step period presetter 41.

When the washer motor 105 begins to be rotated under the above-mentioned arrangement, the motor current detector 101 sends forth a motor current detection signal having an analog quantity. The signal is converted into a signal having a digital quantity by the A/D converter 107. The converted digital signal is conducted to the gate circuit 108. When the washer motor 105 is started, the motor start detector 112 sends forth start signal to an AND circuit 113, which in turn allows for the passage of clock pulses. The counter 111 counts these clock pulses. Comparison is always made in the comparator 109 between a signal denoting a count made by the counter 111 and a signal representing a specified length of time which is issued from the time presetter 110. Where the prescribed length of time $T_a$ passes after the start of the washer motor 105, that is, where coincidence takes place between a signal indicating a count made by the counter 111 and a signal denoting the prescribed length of time $T_a$, then the comparator 109 produces a coincidence pulse, causing the gate circuit 108 to be opened. Thus, a signal showing the motor current generated after the prescribed length of time $T_a$ is supplied through the gate circuit 108 to the operaton step period presetter 41 as a signal denoting a charged quantity of material of washing. Thereafter, actually required length of time are preset for the respective operation steps as in the foregoing embodiment.

There will now be described by reference to FIG. 12 the arrangement and operation of still another modification of the detector 40 of a charged quantity of material of washing. The parts of FIG. 12 the same as those of the preceding embodiments are denoted by the same numerals, description thereof being omitted. FIG. 12 is a block diagram of the second modification 40-2 of the detector 40 of a charged quantity of material of washing shown in FIG. 4. The detector 40-2 of the second modification is operated by the same principle as already described. In the embodiment of FIG. 12, however, the charged quantity of material of washing is detected by an average value of the magnitudes of washer motor current.

In this third embodiment, the output terminal of the comparator 109 is not directly connected to the control terminal of the gate circuit 108, but through a second AND circuit 114, one of whose input terminals is supplied with clock pulses and a second counter 15. The gate circuit 108 is connected to one of the input terminals of a second processor 118 through the storing circuit 116 and a first processor 117. The other terminal of the second processor 118 is connected to a current presetter 119. Said second processor 118 is further connected to the operation step period presetter 41.

Where a coincidence pulse is issued from the comparator 109 in the detector 40-2 of the charged quantity of material of washing arranged as described above in the prescribed length of time $T_a$ after the start of the washer motor 105, then clock pulses passing through the second AND circuit 114 are counted by the second counter 115. Then the second counter 115 successively issues a plurality of signals denoting different points of time, for example, $T_{a1}$, $T_{a2}$, $T_{a3}$ which are delayed by some seconds from the respective preceding points of time as measured from the prescribed length of time $T_a$. Thus the gate circuit 108 is opened at the above-mentioned points of time $T_{a1}$, $T_{a2}$, $T_{a3}$. Signals representing the magnitudes of the current of washer motor 105 at these points of time are stored in the storing circuit 116. Later, the magnitudes of the motor current are added together to be averaged per point of time by the first processor 117. Comparison is made by the second processor 118 between said averaged motor current magnitude and the magnitude of motor current preset in the current presetter 119. A signal denoting a value substantially proportional to a difference between both magnitudes of motor current is supplied to the operation step period presetter 41 to indicate a charged quantity of material of washing.

The third embodiment of FIG. 12 has the advantage that where a signal denoting motor current unrelated to the charged quantity of material of washing happens to be detected, approximate information on the charged quantity of material of washing can still be obtained, because the magnitudes of motor current produced at different points of time are averaged.

The operation step period presetter used with the automatic washer of this invention can be designed to define the length of time actually required for the respective operation steps not only a previously mentioned, but also as described below.

Now let it be assumed that as shown in FIG. 13, a washer motor is intermittently driven and stopped during washing or rinsing in order to eliminate the twisting of the charged material of washing thereby to facilitate the rotation thereof. If, in this case, not only a length of time $T_W$ required for a washing or rinsing cycle, but also a period $T_e$ of the intermittent drive of the washer motor and a period $T_f$ of the intermittent stop thereof are determined in accordance with the charged quantity of material of washing, then it is possible to define an optimum force of water streams to eliminate the above-mentioned twisting of the charged material of washing and a period required for an overall cycle consisting of a washing or rinsing step and other related steps.

Further, let it be supposed that the washer motor is intermittently driven and stopped during dehydration as shown in FIG. 13. In FIG. 14 a dehydration time $T_d$ is plotted on the abscissa, and a number of rotation $N_S$ of a dehydration tub is shown on the ordinate. A curve $\mathbf{14}_c$ denotes the rotation characteristic of a washer motor when continuously driven, and a wave line $\mathbf{14}_d$ indicates the rotation characteristic of the washer motor when intermittently driven. In this case, a period $T_g$ of the intermittent drive of the washer motor and a period $T_h$ of the intermittent stop thereof are respectively chosen to be proportional to the intermittent drive period $T_e$ and the intermittent stop period $T_f$ of the washer motor during the aforesaid washing cycle, as indicated by the following equations:

$$T_g = K_1 \times T_e$$

$$T_h = K_2 \times T_f$$

where $K_1$ and $K_2$ are proportion constants. Or a dehydration period may be chosen to be proportional to the intermittent drive period $T_e$ of a washer motor during a washing cycle. Further, it is possible to make the dehydration period proportional to the intermittent drive period $T_e$ of the washer motor during the washing cycle and also render the intermittent drive period $T_g$ and intermittent stop period $T_h$ of the washer motor during the dehydration cycle respectively proportional to the intermittent drive period $T_e$ and intermittent stop period $T_f$ of the washer motor during the washing cycle. This arrangement can adjust a number of rotation of the dehydration tub to match the charged quantity of material of washing, thereby preventing the material of washing from being creased if the dehydration tub is rotated too forcefully.

What is claimed is:

1. An automatic washer for washing a quantity of material, during a series of successive operation steps including at least a washing cycle and a dehydration cycle which operation steps continue for respective corresponding periods of time, said washer comprising:

drive means, having an operating characteristic during said washing cycle dependent on the amount of said quantity of material, for rotating a stirring blade member during said washing cycle and a dehydration tub during said dehydration cycle;

means for measuring said drive means operating characteristic during said washing cycle and for issuing a signal during said washing cycle corresponding to said operating characteristic denoting the amount of said quantity of material; and control means, coupled to said drive means and responsive to said signal, for presetting the lengths of said respective corresponding periods of time as a function of said amount of said quantity of material.

2. The automatic washer according to claim 1, wherein said operating characteristic is the length of time required for said drive means to rotate said stirring blade member a prescribed number of times.

3. The automatic washer according to claim 1, wherein said drive means comprises an electric motor powered by a drive current, and said operating characteristic includes the magnitude of said drive current at each of at least one prescribed length of time into said washing cycle.

4. The automatic washer according to claim 3, wherein said measuring and issuing means comprises:

means for measuring the magnitude of said drive current at different points of time each successively delayed from the respective preceding one of said different points of time by a certain length of time following said prescribed length of time;

means for producing a signal denoting the average value of said drive current magnitude measured at said different points of time; and means for measuring, and issuing a signal denoting, the difference betweeen a preselected drive current magnitude and said average value of said drive current magnitude.

5. The automatic washer according to any one of claims 2-4, wherein said control means further comprises means for causing said drive means to intermittently rotate and stop said stirring blade member during said washing cycle for periods of time having lengths corresponding to said signal, said lengths denoting said amount of said quantity of material.

6. The automatic washer according to claim 5, wherein said control means includes means for causing said drive means to intermittently rotate and stop said tub during said dehydration cycle for periods of time respectively proportional to the lengths of said rotate and stop periods of time during said washing cycle.

7. The automatic washer according to claim 5, wherein said control means includes means for causing the length of said period of time corresponding to said dehydration cycle to be proportional to the length of said rotate period of time during said washing cycle.

8. The automatic washer according to claim 7, further comprising means for causing said drive means to intermittently rotate and stop during said dehydration cycle for lengths of periods of time respectively substantially proportional to the lengths of said rotate and stop periods of time during said washing cyle.

* * * * *